US009378712B2

(12) United States Patent
Owen

(10) Patent No.: US 9,378,712 B2
(45) Date of Patent: Jun. 28, 2016

(54) DRUM BEATER PEDAL APPARATUS UTILIZING PROXIMAL ACTUATION

(71) Applicant: Bob Owen, Black Mountain, NC (US)

(72) Inventor: Bob Owen, Black Mountain, NC (US)

( * ) Notice: Subject to any disclaimer, the term of this patent is extended or adjusted under 35 U.S.C. 154(b) by 60 days.

(21) Appl. No.: 14/480,374

(22) Filed: Sep. 8, 2014

(65) Prior Publication Data

US 2016/0071500 A1 Mar. 10, 2016

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
USPC ..... 84/422.1
See application file for complete search history.

(56) References Cited

U.S. PATENT DOCUMENTS 1,508,390 A 9/1924 William
2,484,302 A 10/1949 Laverents
2,672,784 A 3/1954 Sabo
4,235,146 A * 11/1980 Purdy ..... G10D 13/006 84/225
5,090,289 A * 2/1992 Holcomb ..... G10D 13/006 84/422.1
5,355,761 A 10/1994 Ward et al.
5,458,039 A 10/1995 Ashby
5,866,830 A 2/1999 Onyszkanycz
6,002,076 A * 12/1999 Karn ..... G10D 13/006 84/236
7,408,104 B2 * 8/2008 Sato ..... G10D 13/006 84/422.1
7,579,538 B2 * 8/2009 Franz ..... G10D 13/06 84/402
2012/0073425 A1 * 3/2012 Hashimoto ..... G10H 1/348 84/746
2012/0152085 A1 6/2012 Gordon

* cited by examiner

*Primary Examiner* — Christopher Uhlir
(74) *Attorney, Agent, or Firm* — The Keys Law Firm PLLC

(57) ABSTRACT

A drum beater pedal apparatus for driving a pedal driven drum beater with manual pressure from the heel comprises a pedal member, a frame, a spring, a sliding member, a chain and a drum beater. The pedal member is movably mounted on the frame such that it can be moved between a base position and an actuated position. In this regard, when manual pressure in the actuating direction is placed on the proximal end of the pedal member, the sliding member moves to its substantially horizontal position and causes the chain to move the drum beater to its actuated position. Conversely, when this manual pressure is removed, the spring moves the pedal member back to its base position, causing the sliding member to move to its substantially vertical position, resulting in the chain moving the drum beater 16 to its retracted position.

3 Claims, 2 Drawing Sheets

DRUM BEATER PEDAL APPARATUS UTILIZING PROXIMAL ACTUATION

BACKGROUND OF THE INVENTION

1. Field of the Invention

This invention relates generally to percussion instrument actuators and, more particularly, to a drum beater pedal apparatus that is actuated by depressing the pedal's proximal end.

2. Description of the Prior Art

The use of pedal driven actuators for drum or cymbal beaters (or mallets) to play such a percussion instrument is well known. Such pedal driven actuators are commonly used with bass drums and are typically configured with a chain connected to both the pedal and the beater such that when a performer places his foot on the pedal and depresses the distal end of the pedal, relative to the performer, the chain moves the beater into the face of a drum. Repeatedly depressing the distal end of the pedal, however, generally requires the performer to use the toe area of the foot. Consequently, a problem which still exists is that the footwork required to repeatedly actuate a pedal driven actuator in this configuration often leads to improper posture and/or tendonitis in the performer's Achilles. Thus, there remains a need for a pedal apparatus for a drum beater that drives the drum actuator in response to pressure on its proximal end. It would be helpful if such a proximally actuated drum beater pedal apparatus included a spring mechanism to return the pedal to its initial, base position when manual pressure is removed. It would be additionally desirable for such a proximally actuated drum beater pedal apparatus to include a sliding member to transfer the motion from the pedal being depressed to a chain that drives the drum beater.

The Applicant's invention described herein provides for a proximally actuated drum beater pedal apparatus adapted receive manual pressure from a performer's heel and drive a drum actuator in response thereto. The primary components in Applicant's proximally actuated drum beater pedal apparatus are a pedal, a frame, a spring, and a sliding member. When in operation, the proximally actuated drum beater pedal apparatus enables a drum beater to be driven through a more ergonomical motion. As a result, many of the limitations imposed by prior art structures are removed.

SUMMARY OF THE INVENTION

A drum beater pedal apparatus for driving a pedal driven drum beater with manual pressure from the heel. The proximally actuated drum beater pedal apparatus comprises a pedal member, a frame, a spring, a sliding member, a chain and a drum beater. The pedal member is movably mounted on the frame such that it can be moved between a base position and an actuated position through the application of manual pressure in a pedal actuating direction about the proximal end of the pedal member. In this regard, when manual pressure in the actuating direction is placed on the proximal end of the pedal member, the sliding member moves to its substantially horizontal position and causes the chain to move the drum beater to its actuated position. Conversely, when this manual pressure is removed, the spring moves the pedal member back to its base position, causing the sliding member to move to its substantially vertical position, resulting in the chain moving the drum beater 16 to its retracted position.

Accordingly, the frame provides a means for supporting, the drum beater provides a means for striking a percussion instrument, and the pedal member and chain provide a means for actuating the drum beater.

It is an object of this invention to provide a proximally actuated drum beater pedal apparatus for a drum beater that drives the drum actuator in response to pressure on its proximal end.

It is another object of this invention to provide a proximally actuated drum beater pedal apparatus that includes a spring mechanism to return the pedal to its initial, base position when manual pressure is removed.

It is yet another object of this invention to provide a proximally actuated drum beater pedal apparatus having a sliding member to transfer the motion from the pedal being depressed to a chain that drives the drum beater.

These and other objects will be apparent to one of skill in the art.

DETAILED DESCRIPTION OF THE INVENTION

Figure 1:
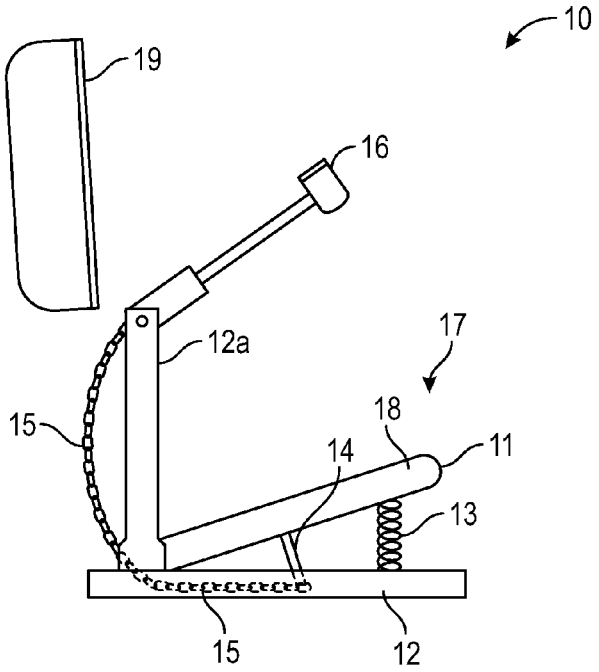
FIG. 1 is a side elevational view of a proximally actuated drum beater pedal apparatus built in accordance with the present invention having its pedal in the base position and the drum beater in the retracted position and its chain partially in shadow.
Figure 2:
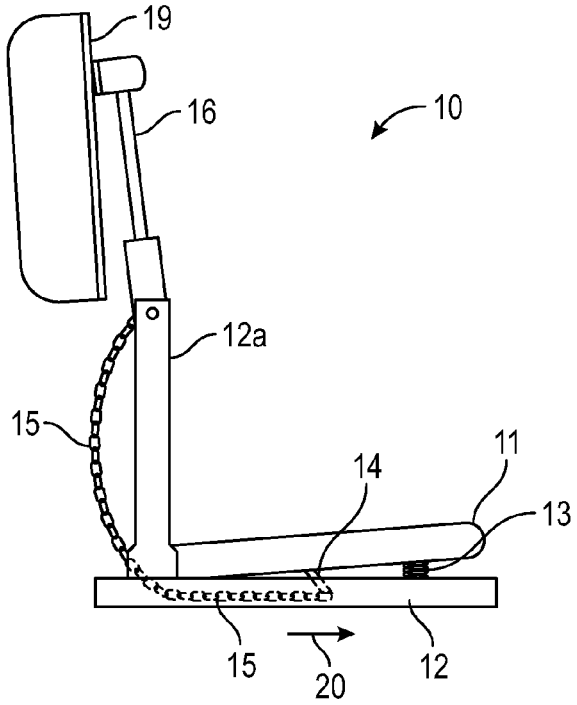
FIG. 2 is a side elevational view of a proximally actuated drum beater pedal apparatus built in accordance with the present invention having its pedal in the actuated position and the drum beater in the actuated position and its chain partially in shadow.
Figure 3:
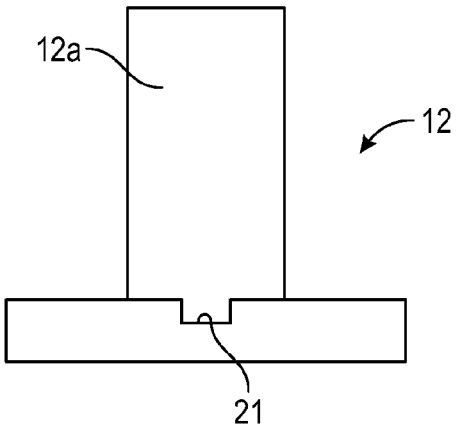
FIG. 3 is a front elevational view of the frame of a proximally actuated drum beater pedal apparatus built in accordance with the present invention.

Referring now to the drawings and in particular FIGS. 1, 2 and 3, a proximally actuated drum beater pedal apparatus 10 is shown having a pedal member 11, a frame 12, a spring 13, a sliding member 14, a chain 15 and a drum beater 16. The pedal member 11 is movably mounted on the frame such that it can be moved between a base position, as shown in FIG. 1, and an actuated position, as shown in FIG. 2, through the application of manual pressure in a pedal actuating direction 17 about the proximal end 18 of the pedal member 11. The proximally actuated drum beater pedal apparatus 10 is designed to be placed next to a percussion instrument, such as a drum 19, such that the drum beater 16 strikes the drum 19 when it moves to its actuated position.

Underneath the pedal member 11, disposed on the frame 12 therebeneath, is the spring 13 and the sliding member 14. The spring 13 is fixedly attached to the pedal member 11 and the frame 12 and exerts pressure opposite the pedal actuation direction on the proximal end 18 of the pedal member 11. The sliding member 14 is fixedly attached to the pedal member and slidably attached to the frame 11, enabling it to slide between a substantially vertical position when the pedal member 11 is in its base position to a substantially horizontal position when the pedal member 11 is moved to its actuated position. The sliding member 14 is connected to the chain 15, and when the sliding member 14 is moved to its substantially horizontal position, it moves the chain 15 in a pulling direction 20. The chain 15 extends from its connection to the sliding member 14 in a groove 21 in the frame 12, through the groove 21 in the frame 12, and up the spine 12*a* of the frame to a connection with the drum beater 16. Through the chain's 15 connection, the sliding member 14 being moved into its substantially horizontal position causes the drum beater 16 to move to its actuated position.

Accordingly, when manual pressure in an actuating direction 17 is placed on the proximal end 18 of the pedal member 11, the sliding member 14 moves to its substantially horizontal position and causes the chain 15 to move the drum beater 16 to its actuated position. When this manual pressure is removed, the spring 13 moves the pedal member 11 back to its base position, causing the sliding member 14 to move to its substantially vertical position, resulting in the chain 15 moving the drum beater 16 to its retracted position.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A drum beater pedal apparatus, comprising:

a frame having a pedal member and a drum beater movable disposed thereon;

a pedal member having a proximal end, wherein said pedal member is movable between a base position and an actuating position through the application of directional pressure;

a drum beater movable from a retracted position to an actuated position, wherein said drum beater is connected to said pedal member such that the application of manual pressure in an actuating direction on the proximal end of the pedal member causes the drum beater to move from its retracted position to its actuated position;

a sliding member fixedly attached to said pedal member and slidably attached to said frame, wherein said sliding member is slidably movable between a substantially vertical position that corresponds to the pedal member being in its base position and a substantially horizontal position that corresponds to the pedal member being in its actuating position; and a chain connected to said sliding member and to said drum beater, wherein said chain is operative to move said drum beater from its retracted position to its actuated position when the sliding member moves from its substantially vertical position to its substantially horizontal position.

2. The drum beater pedal apparatus of claim 1, additionally comprising a spring fixedly connected to said frame and said pedal member, wherein said spring biases said pedal member to move to said base position.

3. A drum beater pedal apparatus, comprising:

a frame having a pedal member and a drum beater movable disposed thereon;

a pedal member having a proximal end, wherein said pedal member is movable between a base position and an actuating position through the application of directional pressure;

a drum beater movable from a retracted position to an actuated position, wherein said drum beater is connected to said pedal member such that the application of manual pressure in an actuating direction on the proximal end of the pedal member causes the drum beater to move from its retracted position to its actuated position;

a spring fixedly connected to said frame and said pedal member, wherein said spring biases said pedal member to move to said base position;

a sliding member fixedly attached to said pedal member and slidably attached to said frame, wherein said sliding member is slidably movable between a substantially vertical position that corresponds to the pedal member being in its base position and a substantially horizontal position that corresponds to the pedal member being in its actuating position; and a chain connected to said sliding member and to said drum beater, wherein said chain is operative to move said drum beater from its retracted position to its actuated position when the sliding member moves from its substantially vertical position to its substantially horizontal position.

* * * * *